US009051910B2

(12) United States Patent
Feng et al.

(10) Patent No.: US 9,051,910 B2
(45) Date of Patent: Jun. 9, 2015

(54) VALVE ASSEMBLY FOR FUEL SYSTEM AND METHOD

(71) Applicant: Caterpillar, Inc., Peoria, IL (US)

(72) Inventors: Bao Feng, Dunlap, IL (US); Steven C. Taylor, Germantown Hills, IL (US); Lucy V. Berg, Thomasville, GA (US); Colm M. Flannery, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 295 days.

(21) Appl. No.: 13/755,391

(22) Filed: Jan. 31, 2013

(65) Prior Publication Data

US 2014/0209063 A1 Jul. 31, 2014

(51) Int. Cl.

| | |
|---|---|
| ***F02M 61/18*** | (2006.01) |
| ***C23C 14/02*** | (2006.01) |
| ***F02M 61/16*** | (2006.01) |
| *F02M 63/00* | (2006.01) |
| *F02M 47/02* | (2006.01) |

(52) U.S. Cl.

CPC ..... *F02M 61/166* (2013.01); *F02M 61/1886* (2013.01); *F02M 63/0015* (2013.01); *F02M 63/004* (2013.01); *F02M 2200/9046* (2013.01); *F02M 61/1893* (2013.01); *F02M 63/0077* (2013.01); *F02M 63/0045* (2013.01); *F02M 47/027* (2013.01); *F02M 2200/9038* (2013.01); *F02M 2200/02* (2013.01)

(58) Field of Classification Search

CPC ..... F02M 61/18; F02M 61/1886; F02M 61/1893; F02M 59/445; C23C 14/025; C23C 14/0641; C23C 14/0611; C23C 14/0635

USPC ..... 239/533.2, 88; 251/129.01, 333, 334, 251/368; 137/375; 428/457

See application file for complete search history.

(56) References Cited

U.S. PATENT DOCUMENTS

| | | | | |
|---|---|---|---|---|
| 5,012,982 | A | 5/1991 | Souma et al. | |
| 5,370,364 | A * | 12/1994 | Kenmoku et al. | 251/368 |
| 5,409,165 | A * | 4/1995 | Carroll et al. | 239/88 |
| 6,318,327 | B1 | 11/2001 | Takahashi et al. | |
| 6,715,693 | B1 * | 4/2004 | Dam et al. | 239/88 |
| 6,802,457 | B1 * | 10/2004 | Campion et al. | 239/88 |
| 8,129,041 | B2 | 3/2012 | Ghasripoor et al. | |
| 2003/0089343 | A1 * | 5/2003 | Yamaguchi et al. | 123/495 |
| 2004/0187798 | A1 * | 9/2004 | Schneider et al. | 123/1 A |
| 2006/0118177 | A1 * | 6/2006 | Ucman | 137/375 |
| 2007/0228193 | A1 * | 10/2007 | Kato et al. | 239/533.2 |

(Continued)

FOREIGN PATENT DOCUMENTS

| | | |
|---|---|---|
| EP | 2052789 | 4/2009 |
| JP | 2008196324 | 8/2008 |

(Continued)

*Primary Examiner* — Lindsay Low
*Assistant Examiner* — George Jin
(74) *Attorney, Agent, or Firm* — Liell & McNeil Attorneys, PC

(57) ABSTRACT

A valve assembly in an internal combustion engine fuel system includes a valve member movable within a valve body to contact a valve seat and block fluid communication between first and second passages. The valve seat and valve member each include a multi-layered coating having a harder metal nitride base layer and a softer metal nitride outer layer. The base layer is relatively incompliant to impacts between the valve member and the valve seat, and the outer layer is relatively compliant to the impacts and thereby deformable. Related methodology is disclosed.

20 Claims, 3 Drawing Sheets

(56) References Cited

U.S. PATENT DOCUMENTS

| | | | | |
|---|---|---|---|---|
| 2007/0264491 | A1* | 11/2007 | Asano et al. | 428/327 |
| 2008/0149062 | A1 | 6/2008 | Luepfert | |
| 2008/0152491 | A1* | 6/2008 | Davies | 415/232 |
| 2008/0315146 | A1* | 12/2008 | Brondum et al. | 251/368 |
| 2009/0026292 | A1* | 1/2009 | Davies | 239/533.2 |
| 2009/0078906 | A1* | 3/2009 | Shafer et al. | 251/368 |
| 2009/0087673 | A1* | 4/2009 | Taylor et al. | 428/472 |
| 2009/0159728 | A1 | 6/2009 | Suzuki et al. | |
| 2009/0165749 | A1* | 7/2009 | Ibrahim et al. | 123/472 |
| 2009/0302136 | A1* | 12/2009 | Song | 239/584 |
| 2010/0140529 | A1* | 6/2010 | Ghasripoor et al. | 251/368 |

FOREIGN PATENT DOCUMENTS

| | | | |
|---|---|---|---|
| KR | 10-2001-0073837 | A | 8/2001 |
| WO | 2006117266 | | 11/2006 |

* cited by examiner

VALVE ASSEMBLY FOR FUEL SYSTEM AND METHOD

TECHNICAL FIELD

The present disclosure relates generally to a valve assembly in an internal combustion engine fuel system, and relates more particularly to a multi-layer coating on impacting parts of the valve assembly having a harder metal nitride base layer and a softer metal nitride outer layer.

BACKGROUND

Various fuel system components in modern internal combustion engine fuel systems are subjected to harsh operating conditions. High fuel pressures, debris particles, and repetitively impacting components tend to require the hardware used in such systems to be robust. If not addressed, various in-service and break-in wear phenomena can lead to performance degradation and potentially system failure. Hardening of materials, coating of certain components, and exacting manufacturing tolerances are techniques which have all been used in various forms to prolong fuel system service life.

Commonly owned and co-pending U.S. patent application Ser. No. 11/863,777 to Taylor, et al., now United States Publication No. 2009/0087673, now abandoned, is directed to a method for coating fuel system components. Taylor, et al. teach provision of a substrate and a coating, where the substrate comprises steel and the coating comprises a metal nitride, for use in production of a fuel system component. The strategy in Taylor, et al. appears to result in components resistant to wear. Despite the advantages offered by Taylor, et al., there remains room for improvement.

SUMMARY

In one aspect, a valve assembly for a fuel system in an internal combustion engine includes a valve body having therein a valve seat located fluidly between a first fluid passage and a second fluid passage and being formed of a first metal substrate. The valve assembly further includes a valve member movable within the valve body between a first position at which the valve member contacts the valve seat and blocks fluid communication between the first and second fluid passages, and a second position at which the fluid communication is open, the valve member being formed of a second metal substrate. The valve seat and the valve member each include a multi-layer coating positioned within a sealing interface formed by the contact at the first position, and having a metal nitride base layer adherent to the corresponding first or second metal substrate, and a metal nitride outer layer. The metal nitride base layer has a greater hardness, such that the metal nitride base layer is relatively incompliant to impacts between the valve member and the valve seat at the first position and limits wear of the valve member and the valve seat during service of the valve assembly in the fuel system. The metal nitride outer layer has a lesser hardness, such that the metal nitride outer layer is relatively compliant to the impacts and is thereby deformable to enlarge the sealing interface during break-in of the valve assembly in the fuel system.

In another aspect, a fuel system for an internal combustion engine includes a housing defining a first fuel passage and a second fuel passage, and having a valve seat formed of a first metal substrate and positioned fluidly between the first and second fuel passages. The fuel system further includes a valve assembly positioned at least partially within the housing and configured to control a flow of fuel between the first and second fuel passages, and including a valve member formed of a second metal substrate. The valve member is movable between a first position at which the valve member contacts the valve seat and blocks fluid communication between the first and second fuel passages, and a second position at which the fluid communication is open. The valve seat and the valve member each include a multi-layer coating positioned within a sealing interface formed by the contact at the first position, and having a metal nitride base layer adherent to the corresponding first or second metal substrate, and a metal nitride outer layer. The metal nitride base layer has a greater hardness, such that the metal nitride base layer is relatively incompliant to impacts between the valve member and valve seat at the first position and limits wear of the valve member and the valve seat during service of the valve assembly in the fuel system. The metal nitride outer layer has a lesser hardness, such that the metal nitride outer layer is relatively compliant to the impacts and is thereby deformable to enlarge the sealing interface during break-in of the valve assembly in the fuel system.

In still another aspect, a method of limiting valve damage during breaking-in a valve assembly in a fuel system of an internal combustion engine includes moving a valve member of the valve assembly from a first position at which a first fuel passage and a second fuel passage in the fuel system are in fluid communication via a valve seat, to a second position at which the valve member contacts the valve seat to block the fluid communication. The method further includes transmitting a force of impact of the valve member on the valve seat at the second position from a softer outer layer of a metal nitride coating on at least one of the valve member and the valve seat to a harder base layer of the metal nitride coating adherent to a metal substrate of the at least one of the valve member and the valve seat. The method further includes preventing failure of the harder base layer in response to the transmission of the force via deforming the softer outer layer in response to the impact.

BRIEF DESCRIPTION OF THE DRAWINGS

FIG. 5 is a close-up view of a portion of the components of FIG. 4 at an earlier stage of breaking-in; and FIG. 6 is a view similar to FIG. 5 at a later stage of breaking-in.

DETAILED DESCRIPTION

Figure 1:
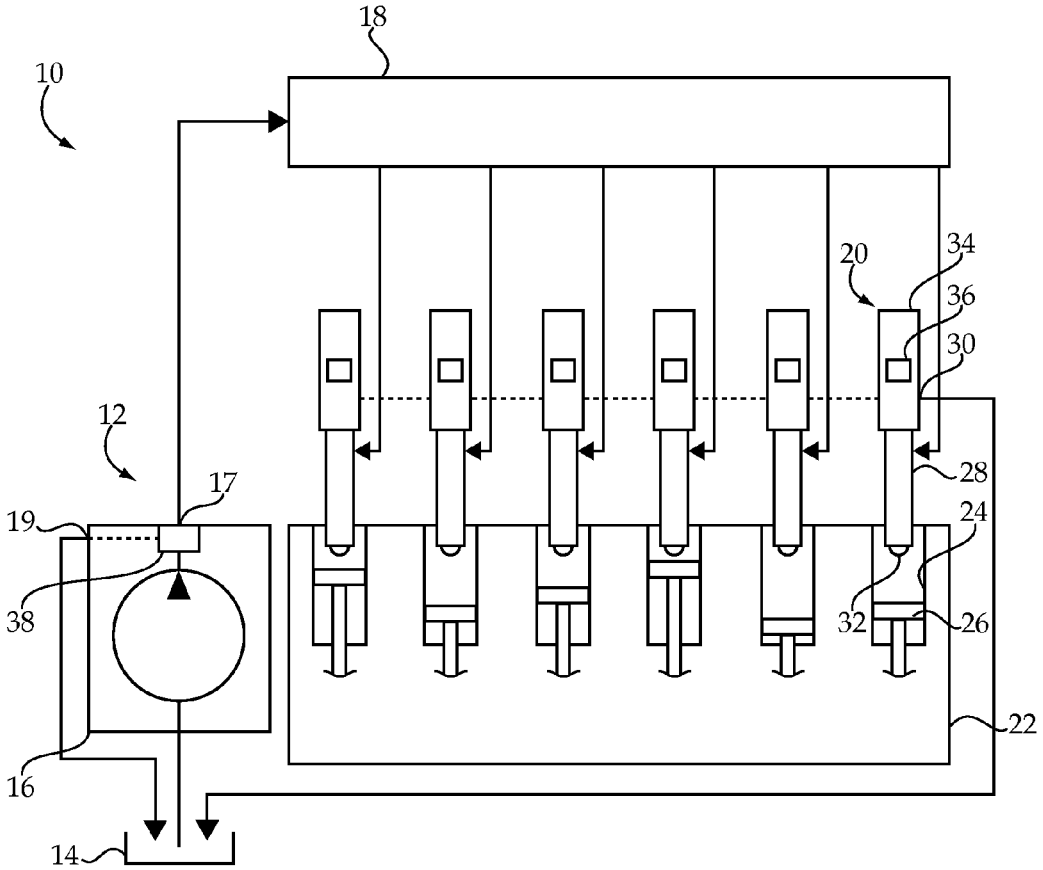
FIG. 1 is a diagrammatic view of an internal combustion engine having a fuel system, according to one embodiment.

Referring to FIG. 1, there is shown an engine 10 having a fuel system 12, according to one embodiment. Engine 10 includes an engine housing 22 having a plurality of cylinders 24 formed therein, and a plurality of pistons 26 reciprocable one within each of cylinders 24 in a conventional manner. In certain embodiments, engine 10 may include a direct fuel injection compression ignition diesel engine, although the present disclosure is not thereby limited. Fuel system 12 may include a fuel tank 14 and a fuel pump 16 configured to pressurize fuel from tank 14 for supplying to a common rail 18. Pump 16 may include a high pressure pump configured to maintain a relatively high pressure of common rail 18, up to 350 mega-Pascals (MPa) in certain embodiments, and an additional low pressure fuel transfer pump might be positioned fluidly between fuel tank 14 and pump 16 in certain embodiments. Fuel pump 16 may include a common rail outlet 17 for supplying the pressurized fuel to common rail 18, and a drain outlet 19 for returning pumped fuel not supplied to common rail 18 to fuel tank 14. Fuel system 12 further includes a plurality of fuel injectors 20 each including a fuel injector housing 34 having a high pressure inlet 28 fluidly connected to common rail 18 and a low pressure outlet 30 fluidly connected back to fuel tank 14. While only one of injectors 20 is labeled via reference numerals, those labeled and described features will be understood to be present in all the fuel injectors in fuel system 12. A similar understanding will apply to pistons 26, cylinders 24. Each of fuel injectors 20 may further include a valve assembly 36 positioned at least partially within the corresponding fuel injector housing 34. Each of fuel injectors 20 further includes a nozzle outlet 32 positioned within one of cylinders 24 for injecting fuel therein. Pump 16 may include a valve assembly 38, which may be an outlet metering valve such as the outlet metering valve disclosed in Taylor, et al. discussed above. As will be further apparent from the following description, valve assembly 36 and valve assembly 38 may be uniquely configured for prolonged service life in engine 10 as compared with certain known designs by virtue of unique coatings on certain of the valve assembly components.

Figure 2:
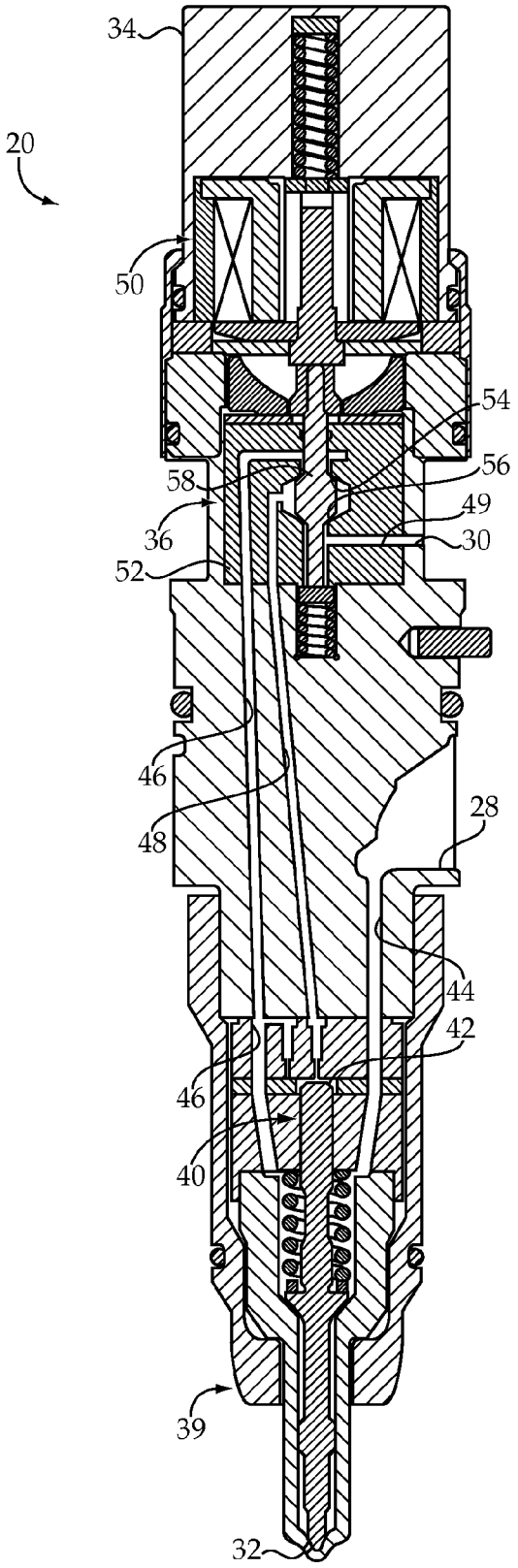
FIG. 2 is a sectioned side diagrammatic view of a fuel injector suitably used in the engine and fuel system of FIG. 1.

Referring now to FIG. 2, there is shown a sectioned side diagrammatic view of one of fuel injectors 20. The design depicted in FIG. 2 is one practical implementation strategy, but those skilled in the art will appreciate that fuel injector 20 is but one of many different fuel system component types and configurations that may fall within the scope of the present disclosure. As alluded to above, fuel injector 20 may include a high pressure inlet 28 formed in housing 34, and configured to fluidly connect with common rail 18 via a quill connector or the like (not shown). High pressure inlet 28 may connect via a nozzle supply passage 44 to a nozzle 39 of fuel injector 20 wherein one or more nozzle outlets 32 are formed as mentioned above. An outlet check 40, such as a known needle check, may be positioned within injector housing 34 and configured to controllably open and close outlet 32 in a generally known manner, as controlled via valve assembly 36. A high pressure fuel passage 46 extends from nozzle 39 to valve assembly 36 and supplies high pressure fuel to the same. A pressure control passage 48 is also formed in housing 34 and extends between valve assembly 36 and outlet check 40, in particular determining a pressure of fuel applied to a closing hydraulic surface 42 of outlet check 40. A drain passage 49 extends from valve assembly 36 to low pressure outlet 30.

As noted above, valve assembly 36 may include a control valve assembly for outlet check 40. Valve assembly 36 may include a valve body 52, which may be considered a part of housing 34, and having therein a valve seat 54 located fluidly between a first fluid passage such as first fuel passage 46 and a second fluid passage, such as second fuel passage 48 or second fuel passage 49. Each of passages 46, 48 and 49 may be understood to be formed in and defined by valve body 52, and similarly understood to be formed in and defined by housing 34 since valve body 52 may be considered a part thereof. Any of passages 46, 48 and 49 might further be understood as a first fluid passage or a first fuel passage, and likewise understood as a second fluid passage or second fuel passage, or as a third fluid passage or third fuel passage. It will thus be appreciated that the labels "first," "second," and "third," may be variously applied, depending upon perspective. In the embodiment shown, valve assembly 36 includes a three-way valve assembly, varying fluid communications among passages 46, 48 and 49, and operably coupled with outlet check 40. In alternative fuel injector design strategies, as well as in other fuel system components, a valve assembly according to the present disclosure might be designed as a two-way valve assembly. Valve assembly 38 may be one such two-way valve assembly design. As a three-way valve assembly implementation, valve body 52 may include therein a second valve seat 56, which can be similarly understood to be located fluidly between first and second fluid or fuel passages.

Valve assembly 36 further includes a valve member 58 movable within valve body 52 between a first position at which valve member 58 contacts valve seat 54 and blocks fluid communication between first and second fluid passages, and a second position at which the fluid communication is open. At the second position, valve member 58 may contact valve seat 56 and block fluid communication between one or both of the first and second fluid passages and a third fluid passage formed within valve body 52. The third fluid passage may be in fluid communication with the first passage at the first position of valve member 58, and valve member 58 being in contact with second valve seat 56 at the second position such that the fluid communication between the first and third passages is blocked. An electrical actuator 50 is coupled with valve member 58 to move it between the first and second positions, in a conventional manner.

Figure 3:
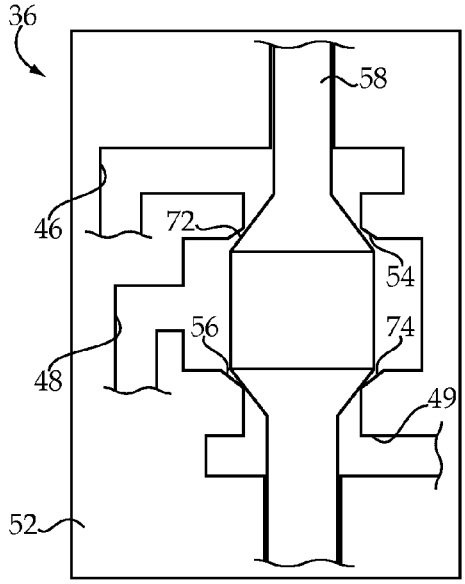
FIG. 3 is a diagrammatic view of a valve assembly, according to one embodiment.

Referring now to FIG. 3, there is shown an enlarged view of valve assembly 36 illustrating certain features in greater detail. A variety of different seat and valve configurations are contemplated within the scope of the present disclosure, and in a practical implementation strategy each of first and second valve seats 54 and 56 may include a conical valve seat. Valve member 58 may include a first and a second seat-contacting surface 72 and 74 configured to contact first and second valve seats 54 and 56 at the first and second positions of valve member 58, respectively. Also in a practical implementation strategy, each of first and second valve seats 54 and 56 may define a larger cone, and first and second seat contacting surfaces 72 and 74 may each define a smaller cone. In such a design, the contact between first and second valve seats 54 and 56 and corresponding surfaces 72 and 74 at the first and second positions includes a line pattern of contact formed by impingement of a "knife edge" of conical seats 54 and 56 upon surfaces 72 and 74. This arrangement might be reversed, such that the cones defined by the valve seats are smaller and the cones defined by seat contacting surfaces are larger, and the valve member forms the impinging knife edge. As valve assembly 36 breaks-in this pattern of contact will tend to change, as further described herein. In still other embodiments, a valve seat and valve member in an arrangement known in the art as a plate and ball valve could be used.

Figure 4:
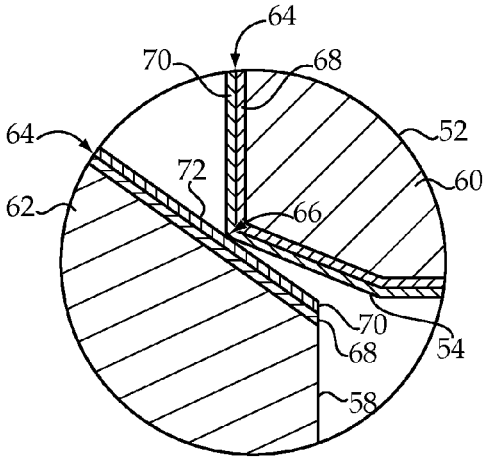
FIG. 4 is a sectioned side diagrammatic view of a portion of interfacing valve components, according to one embodiment.

Referring also now to FIG. 4, there is shown a detailed enlargement of valve member 58 and valve body 52 as they might appear where valve member 58 contacts valve seat 54 to block fluid communication between first and second fluid passages as discussed herein. As mentioned above, contact between valve seat 54 and surface 72 may include a line pattern of contact, at a sealing interface 66 formed by the contact between valve member 58 and valve body 52 at the first position. It will be understood from the FIG. 4 illustration that a line pattern of contact at sealing interface 66 may be generally circular, and extending about valve member 58 upon surface 72 in a plane oriented normal to a direction of reciprocation of valve member 58 between its first and second positions.

As noted above, a unique strategy of coating valve components according to the present disclosure is considered to prolong service life. To this end, each of valve seats 54 and 56 and valve member 58 may include a multi-layer coating 64 positioned within sealing interface 66 formed by the contact at the first position, and within an analogous sealing interface formed by contact between valve member 58 and valve seat 56 at the second position. A contacting valve seat and valve member in valve assembly 38 may be analogously coated. Valve body 52 may be formed of a first metal substrate 60, and valve member 58 may be formed of a second metal substrate 62. In one embodiment, substrates 60 and 62 may consist of the same material, which may be a hardened steel material having a Rockwell hardness of about 55 (HRC scale) or greater. Multi-layer coating 64 may have a metal nitride base layer 68 adherent to the corresponding first or second metal substrates 60 or 62, and a metal nitride outer layer 70. A surface finish on each of substrates 60 and 62 to which base layer 68 is adherent may have a roughness average (Ra) of about 0.0001 mm, as determined by deflection of a stylus in a conventional manner. As used herein, the term "about" may be understood in the context of conventional rounding to a consistent number of significant digits. Thus, "about 55" means from 54.5 to 55.4, "about 0.1" means from 0.05 to 0.14. As to ratios, "about 1:1" means a ratio from 0.5 to 1, to 1.4 to 1.

Base layer 68 may have a greater hardness, such that base layer 68 is relatively incompliant to impacts between valve member 58 and valve seat 54 at the first position and limits wear of valve member 58 and valve seat 54 during service of valve assembly 36 in fuel system 12. Wear of valve seat 56 is analogously limited. Outer layer 70 may have a lesser hardness, such that outer layer 70 is relatively compliant to the impacts, and is thereby deformable to enlarge sealing interface 66 during break-in of valve assembly 36 in fuel system 12. The sealing interface at valve seat 56 will be analogously enlarged. In a practical implementation strategy, a thickness of coating 64 on valve member 58 and valve seat 54 is from about 0.005 mm to about 0.020 mm, and a ratio of a thickness of base layer 68 to a thickness of outer layer 70 is from about 1:1 to about 1:10.

The greater hardness of base layer 68 may be uniform throughout base layer 68, and the lesser hardness of outer layer 70 may be non-uniform throughout outer layer 70, and such that outer layer 70 is hardest at an inward location adjacent base layer 68 and transitions to softest at an exposed outward location spaced from base layer 68. A number of layers greater than two might be used in certain embodiments. The steel of first and second substrates 60 and 62 may have a hardness less than the lesser hardness of outer layer 70 at the outward location. The hardness of outer layer 70 may be about three times the hardness of substrate materials 60 and 62, at the softest part of outer layer 70, although the present disclosure is note thereby limited. Hardness of coating 64 may be from about 13 giga-Pascals (GPa) to about 30 giga-Pascals. Given these general parameters, it may be understood that substrates 60 and 62 are relatively hard, outer layer 70 is relatively harder, and hardest adjacent and typically adjoining base layer 68 and softest at its outermost exposed location. Base layer 68 is hardest of all. These general features are considered to allow the materials of valve member 58 and valve body 52 to function as a system, with resistance to various forms of damage during service as further discussed herein. Deposition of coating(s) 64 may take place via physical vapor deposition, in a single batch, with the parameters varied for deposition of the different layers.

In practical implementation strategies, each of base layer 68 and outer layer 70 is formed of a transition metal nitride, and a transition metal content of base layer 68 may be less than a transition metal content of outer layer 70. Outer and softer layer 70 may be inversely graduated in hardness as noted above, and graduated in the transition metal content from the inward location adjacent base layer 68 to the outward location to obtain this property. The transition metal nitride forming base layer 68 and outer layer 70 may include chromium nitride. A ratio of chromium to nitrogen in base layer 68 may be about 2:1, or less, and a ratio of chromium to nitrogen in outer layer 70 may be about 9:1, or less. Other metals, and in particular transition metals, may provide differing properties than chromium nitride, such as adhesion to the metal substrate, but may nevertheless fall within the scope of the present disclosure.

INDUSTRIAL APPLICABILITY

As noted above, the teachings of the present disclosure may be applied to limit valve damage in a valve assembly in a fuel system of an internal combustion engine. Limiting the valve damage may occur during service in the fuel system, and also occur during breaking-in a valve assembly. Many wear resistant, hard coatings and the like tend to be brittle. It has been observed that during break-in of certain valve assemblies coated with hard material coatings, cracking and/or de-lamination of the relatively brittle coating material can occur, resulting in metal on metal contact between a valve member and a valve seat. As a result, the metal substrate of at least one of the valve member and the valve seat can be unduly packed via post-delamination impacts between the valve member and the valve seat, resulting in an increase in valve member travel distance, leading to performance degradation and/or failure. De-lamination of protective coatings can also have the unsurprising result of subjecting the metal substrates to erosion via hard debris particles as well as deformation from such debris particles being pounded into the metal substrate. Erosion and deformation caused by debris can result in valve sealing problems, or raise other concerns.

The present disclosure is considered to address these and other concerns, by way of the unique coatings disclosed herein. To this end, outer layer 70 may be relatively more metal-like or ductile and serve as a buffer layer against impacts by debris trapped between the contacting valve surfaces. This tends to have the desirable effect of inhibiting crack initiation and propagation in the relatively harder and wear resistant base layer. In addition, the outer layer will tend to be plastically deformable to transition the sealing interface between the valve components from a knife-edge or line contact pattern to an enlarged band or surface contact pattern, spreading out the force of subsequent impacts.

Figure 5:
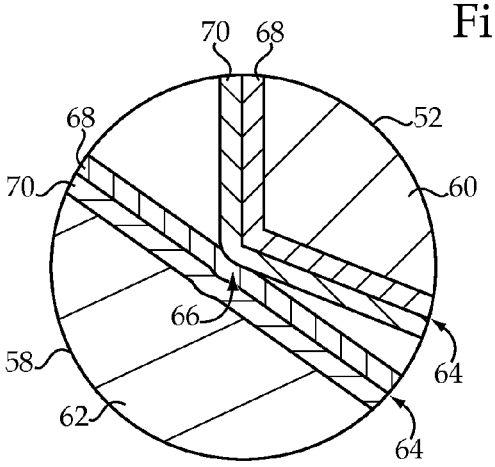
Figure 6:
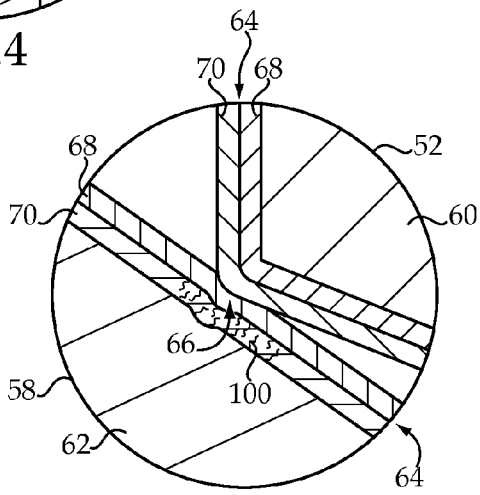

Referring generally now to FIGS. 4, 5 and 6, FIG. 4 depicts valve member 58 and valve seat 54 as they might appear when initially placed in service and prior to breaking-in. Valve member 58 has been moved from a first position at which a first fuel passage and a second fuel passage, as described herein, in fuel system 12 are in fluid communication via valve seat 54, to a second position at which valve member 58 contacts valve seat 54 to block the fluid communication. A force of impact of valve member 58 on valve seat 54 at the second position, as shown in FIG. 4, may be transmitted from softer outer layer 70 to harder base layer 68, and from base layer 68 into the corresponding metal substrate 60 or 62. At the stage shown in FIG. 4, little or no deformation of coating 64 or the corresponding metal substrates 60 and 62 has yet occurred. In response to additional impacts between valve member 58 and valve seat 52, outer layer 70 may be plastically deformed such that sealing interface 66 is enlarged via the subsequent impact. In FIG. 5 it can be noted that some plastic deformation of coating 64 on each of valve member 58 and valve seat 54 has begun to occur, and metal substrate 62 has itself been slightly plastically deformed.

In FIG. 6, valve member 58 and valve body 52 are shown as they might appear approximately after having been broken-in. Outer layer 70 on each of valve member 58 and valve seat 54 has been further plastically deformed such that sealing interface 66 has the form of a contact band. At least upon valve member 58, outer layer 70 has plastically deformed to a greater relative extent, base layer 68 has plastically deformed to a medium relative extent, and substrate 62 has plastically deformed to a lesser relative extent. An increase in a travel distance of valve member 58 from the FIG. 4 state to the FIG. 6 state may be about 0.005 mm, or less. An increase in travel distance in similar but uncoated valve assemblies, and valve assemblies with failed coatings has been observed to be up to 0.080 millimeters, and possibly greater.

It may also be noted that a plurality of cracks 100 have formed in base layer 68 on valve member 58 in FIG. 6. It is believed that transitioning between the harder base layer and the softer outer layer can inhibit crack propagation through coating 64, preventing failure of base layer 68 in response to the transmission of the force of impact, and via the deformation of softer outer layer 70 in response to the impacts. While it is contemplated that preventing failure of the harder base layer occurs during breaking-in, it will be appreciated in light of the foregoing discussion that failure of the harder base layer in coatings according to the present disclosure can also be prevented during post break-in service. Damage to the coated components of valve assembly 36, i.e. the metal substrates, can be limited by preventing debris erosion via base layer 68 of, and also preventing deformation damage from debris impacts which could occur even if de-lamination does not, via the buffering of outer layer 70.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

What is claimed is:

1. A valve assembly for a fuel system in an internal combustion engine comprising:

a valve body having therein a valve seat located fluidly between a first fluid passage and a second fluid passage and being formed of a first metal substrate;

a valve member movable within the valve body between a first position at which the valve member contacts the valve seat and blocks fluid communication between the first and second fluid passages, and a second position at which the fluid communication is open, and the valve member being formed of a second metal substrate;

the valve seat and the valve member each including a multi-layer coating positioned within a sealing interface formed by the contact at the first position, and having a metal nitride base layer adherent to the corresponding first or second metal substrate, and a metal nitride outer layer;

the metal nitride base layer having a first hardness, such that the metal nitride base layer is relatively incompliant to impacts between the valve member and the valve seat at the first position and limits wear of the valve member and the valve seat during service of the valve assembly in the fuel system; and the metal nitride outer layer having a second hardness, such that the metal nitride outer layer is relatively compliant to the impacts and is thereby deformable to enlarge the sealing interface during break-in of the valve assembly in the fuel system.

2. The valve assembly of claim 1 wherein the first hardness is uniform throughout the base layer, and the second hardness is non-uniform throughout the outer layer such that the outer layer is hardest at an inward location adjacent the base layer and transitions to softest at an outward location spaced from the base layer.

3. The valve assembly of claim 2 wherein each of the base layer and the outer layer is formed of a transition metal nitride, and a transition metal content of the base layer is less than a transition metal content of the outer layer, and wherein the outer layer is graduated in the transition metal content from the inward location to the outward location.

4. The valve assembly of claim 3 wherein the transition metal nitride includes chromium nitride.

5. The valve assembly of claim 4 wherein a ratio of chromium to nitrogen in the base layer is about 2:1, or less, and a ratio of chromium to nitrogen in the outer layer is about 9:1, or less.

6. The valve assembly of claim 3 wherein a thickness of the multi-layer coating on the valve member and the valve seat is from about 0.005 millimeters to about 0.020 millimeters.

7. The valve assembly of claim 6 wherein a ratio of a thickness of the base layer to a thickness of the outer layer is from about 1:1 to about 1:10.

8. The valve assembly of claim 3 wherein the first and second metal substrates each include steel having a hardness less than the second hardness of the outer layer at the outward location.

9. The valve assembly of claim 2 wherein:

the valve assembly includes a three-way valve assembly having a second valve seat, and a third fluid passage formed within the valve body;

the third fluid passage being in fluid communication with the first passage at the first position of the valve member, and the valve member being in contact with the second valve seat at the second position such that the fluid communication between the first and third passages is blocked; and the valve member and the second valve seat each further including the multi-layer coating within a second sealing interface formed by the contact at the second position.

10. The valve assembly of claim 9 wherein each of the first and second valve seats includes a conical valve seat defining a larger cone, and the valve member includes a first and a second seat-contacting surface each defining a smaller cone, such that the contact between the first and second valve seats and corresponding first and second seat-contacting surfaces at the first and second positions includes a line pattern of contact.

11. A fuel system for an internal combustion engine comprising:

a housing defining a first fuel passage and a second fuel passage, and having a valve seat formed of a first metal substrate and positioned fluidly between the first and second fuel passages;

a valve assembly positioned at least partially within the housing and configured to control a flow of fuel between the first and second fuel passages, and including a valve member formed of a second metal substrate and movable between a first position at which the valve member contacts the valve seat and blocks fluid communication between the first and second fuel passages, and a second position at which the fluid communication is open;

the valve seat and the valve member each including a multi-layer coating positioned within a sealing interface formed by the contact at the first position, and having a metal nitride base layer adherent to the corresponding first or second metal substrate, and a metal nitride outer layer;

the metal nitride base layer having a first hardness, such that the metal nitride base layer is relatively incompliant to impacts between the valve member and the valve seat at the first position and limits wear of the valve member and the valve seat during service of the valve assembly in the fuel system; and the metal nitride outer layer having a second hardness, such that the metal nitride outer layer is relatively compliant to the impacts and is thereby deformable to enlarge the sealing interface during break-in of the valve assembly in the fuel system.

12. The fuel system of claim 11 wherein the valve member has a line pattern of contact with the valve seat, such that the sealing interface is circular.

13. The fuel system of claim 12 wherein the valve seat includes a conical valve seat defining a larger cone, and the valve member includes a conical seat-contacting surface defining a larger cone.

14. The fuel system of claim 11 wherein:

the first hardness is uniform throughout the base layer;

the second hardness is non-uniform throughout the outer layer such that the outer layer is hardest at an inward location adjacent the base layer and transitions to softest at an outward location spaced from the base layer; and the first and second metal substrates each include steel having a hardness less than the second hardness of the outer layer at the outward location.

15. The fuel system of claim 14 wherein the metal nitride includes a transition metal nitride, and the outer layer is graduated in transition metal content from the inward location to the outward location.

16. The fuel system of claim 15 wherein:

the metal nitride includes chromium nitride, and a ratio of chromium to nitrogen in the base layer is about 2:1, or less, and a ratio of chromium to nitrogen in the outer layer is about 9:1, or less; and a thickness of the multi-layer coating is from about 0.005 millimeters to about 0.020 millimeters, and a ratio of thickness of the base layer to the outer layer is from about 1:1 to about 1:10.

17. The fuel system of claim 15 wherein the housing includes a fuel injector housing of a fuel injector, and the valve assembly includes a three-way control valve assembly positioned at least partially within the housing and operably coupled with an outlet check of the fuel injector.

18. A method of limiting valve damage during breaking-in a valve assembly in a fuel system of an internal combustion engine comprising the steps of:

moving a valve member of the valve assembly from a first position at which a first fuel passage and a second fuel passage in the fuel system are in fluid communication via a valve seat, to a second position at which the valve member contacts the valve seat to block the fluid communication;

transmitting a force of impact of the valve member on the valve seat at the second position from a softer outer layer of a metal nitride coating on at least one of the valve member and the valve seat to a harder base layer of the metal nitride coating adherent to a metal substrate of the at least one of the valve member and the valve seat; and preventing failure of the harder base layer in response to the transmission of the force via deforming the softer outer layer in response to the impact.

19. The method of claim 18 wherein the step of preventing further includes plastically deforming the softer outer layer, such that a sealing interface formed by the valve member and the valve seat at the first position is enlarged via the impact.

20. The method of claim 19 wherein the softer layer is inversely graduated in hardness, such that the step of preventing further includes deforming a hardest part of the outer layer adjacent the base layer and a softest part of the outer layer at an outward location spaced from the base layer.

* * * * *